United States Patent [19]

Bergstrom

[11] 4,434,984

[45] Mar. 6, 1984

[54] SAILBOAT RACE BOARD GAME APPARATUS

[76] Inventor: Carl D. Bergstrom, 506 Bread and Cheese Hollow Rd., Fort Salonga, N.Y. 11768

[21] Appl. No.: 348,983

[22] Filed: Feb. 16, 1982

[51] Int. Cl.[3] ..... A63F 3/00

[52] U.S. Cl. ..... 273/246; 273/259

[58] Field of Search ..... 273/244, 246, 250, 251, 273/252, 253, 254, 259

[56] References Cited

U.S. PATENT DOCUMENTS

| | | | |
|---|---|---|---|
| 2,831,690 | 4/1958 | Seay | 273/246 X |
| 3,820,791 | 6/1974 | Powers | 273/258 |
| 3,834,708 | 9/1974 | Shoptaugh | 273/242 |

FOREIGN PATENT DOCUMENTS

| | | | |
|---|---|---|---|
| 889725 | 2/1962 | United Kingdom | 273/246 |
| 909119 | 10/1962 | United Kingdom | 273/246 |

*Primary Examiner*—Richard C. Pinkham
*Assistant Examiner*—Matthew L. Schneider
*Attorney, Agent, or Firm*—Steinberg & Raskin

[57] ABSTRACT

Board game apparatus for realistically simulating the action of a sailboat race. The game board has a playing area having a plurality of movement spaces arranged over the major area thereof in a manner so as to define various possible directions of movement of a movement piece representing a sailboat, namely, the northerly, southerly, easterly, westerly, northwesterly, northeasterly, southwesterly and southeasterly directions. The apparatus further includes features for representing various factors normally encountered by a participant in an actual sailboat race such, for example, as the direction of the wind and the direction of the current. A movement direction indicator forms a part of the game board and designates the direction in which the movement piece is moving. A sailing method indicator member is provided which is adapted to be removably affixed to the game board in a selected one of several positions corresponding to the prevailing direction of the wind and which has indicia provided thereon for classifying the direction of movement of the movement piece according to its relationship to the prevailing wind direction. A set of rules for game play are disclosed which govern the movement of the game pieces according to the prevailing wind and current directions, the classification of the direction of movement of the movement piece with respect to the wind direction, as well as according to certain variations set forth on associated play variation cards.

16 Claims, 13 Drawing Figures

FIG. 5A
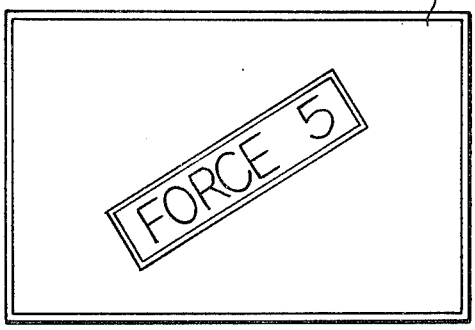
FIG. 5B
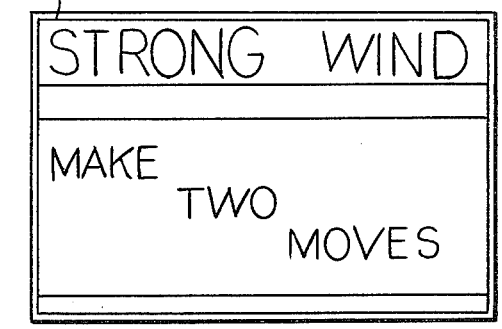
FIG. 6A
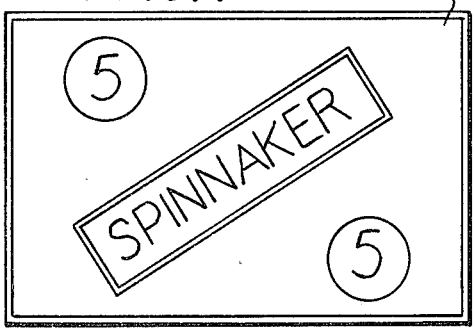
FIG. 6B
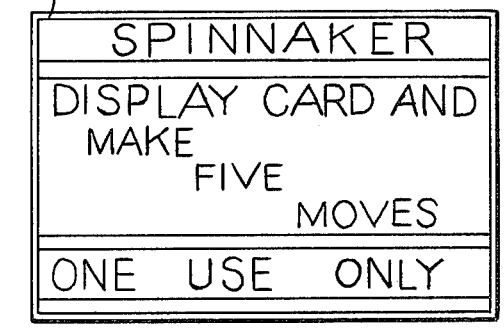
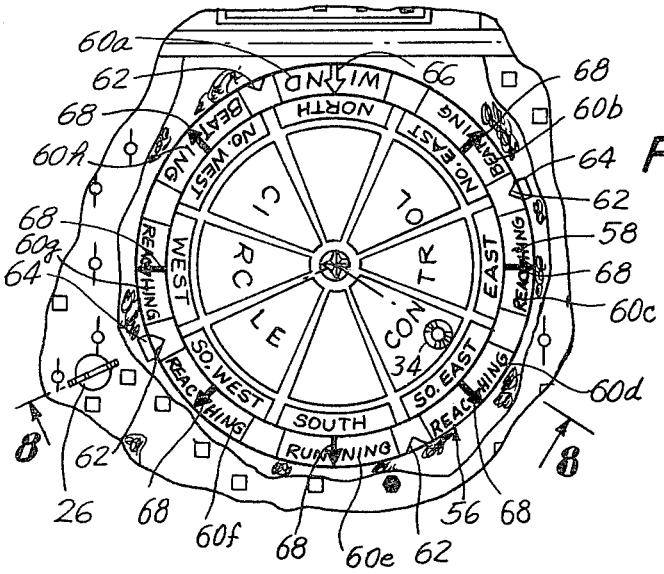
FIG. 7
FIG. 8
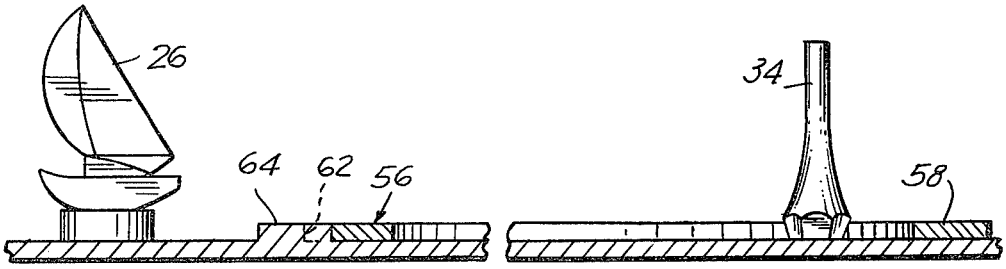

SAILBOAT RACE BOARD GAME APPARATUS

BACKGROUND OF THE INVENTION

This invention relates generally to board game apparatus and, more particularly, to board game apparatus for realistically simulating the action of a sailboat race.

Board game apparatus are known which attempt to simulate various types of race situations. However, prior to the present invention, a board game which provides a realistic simulation of a sailboat race has not been developed.

The problem inherent in the design of a board game apparatus whose play will realistically simulate a sailboat race is that there are several factors or influences which the participant in an actual sailboat race will encounter and which are difficult to duplicate in a board game. More particularly, a sailboat will not be restricted to movement in any particular direction in the water but, in general, will be able to move in any direction except directly against the wind. The direction of the wind as well as the direction of the current will also affect the direction and extent of movement of a sailboat in the water. These factors and influences have not been successfully reproduced in the context of a board game which may be played by children as well as by adults prior to the present invention.

SUMMARY OF THE INVENTION

Accordingly, one object of the present invention is to provide new and improved board game apparatus which realistically simulate the action of a sailboat race.

Another object of the present invention is to provide new and improved board game apparatus which realistically simulate the action of a sailboat race and which takes into account in a realistic fashion the various factors and influences normally encountered by a participant in a sailboat race, e.g., the various possible movement directions of the sailboat, and the affect of the direction of the wind and current on the direction and extent of the movement of the sailboat.

Still another object of the present invention is to provide new and improved board game apparatus which realistically simulate the action of a sailboat race by taking into account in a reliable fashion the various factors and influences normally encountered by a participant in a sailboat race and yet which may be played by children as well as by adults.

Briefly, in accordance with the present invention, these and other objects are attained by providing board game apparatus for realistically simulating the action of a sailboat race, i.e., which takes into account the various factors normally encountered by a participant in an actual sailboat race such, for example, as the various possible directions of movement of a sailboat, the direction of the wind and the direction of the current.

The game board has a playing area having a plurality of movement spaces arranged over the major area thereof in a manner so as to define various possible directions of movement of a movement piece which represents a sailboat, namely, the northerly, southerly, easterly, westerly, northwesterly, northeasterly, southwesterly and southeasterly directions. A movement direction indicator forms a part of the game board and designates the direction in which the movement piece is moving.

A group of wind direction cards are provided which have indicia which designate a particular one of the movement directions in which the prevailing wind is blowing and a positioning area for such cards is provided on the game board on which a wind direction card is situated in a manner such that the wind direction indicia on any card will point in one of the movement directions.

At least a portion of the movement spaces provided on the game board have current direction indicia associated therewith which designate a particular one of the movement directions in which the current is flowing. A group of current direction cards are provided which have indicia which correspond to the current indicia provided on the movement spaces.

A sailing method indicator member is provided which is adapted to be removably affixed to the game board in a selected one of several positions which correspond to the prevailing direction of the wind. Indicia are provided on the sailing method indicator member for classifying the direction of movement of the movement piece according to the relationship between the movement direction thereof and the prevailing wind direction.

A set of rules for game play are disclosed which govern the movement of the movement pieces according to the prevailing wind and current directions, the classification of the direction of movement of the movement piece relative to the wind direction, as well as according to certain variations set forth on associated playing variation cards.

DESCRIPTON OF THE DRAWINGS

A more complete appreciation of the present invention and many of the attendant advantages thereof will be readily appreciated as the same becomes better understood by reference to the following detailed description when considered in connection with the accompanying drawings in which:

FIGS. 5A and 5B are top and bottom views of a typical one of another set of play variation cards;

FIGS. 6A and 6B are top and bottom views of a typical one of yet another set of play variation cards;

FIG. 7 is a plan view of a detail of the game board illustrated in FIG. 1 and further illustrating a sailing method indicator member which has been removably affixed thereto in a selected one of several positions corresponding to the prevailing direction of the wind; and FIG. 8 is a section view taken along lines 8—8 of FIG. 7.

DESCRIPTION OF THE PREFERRED EMBODIMENTS

Figure 1:
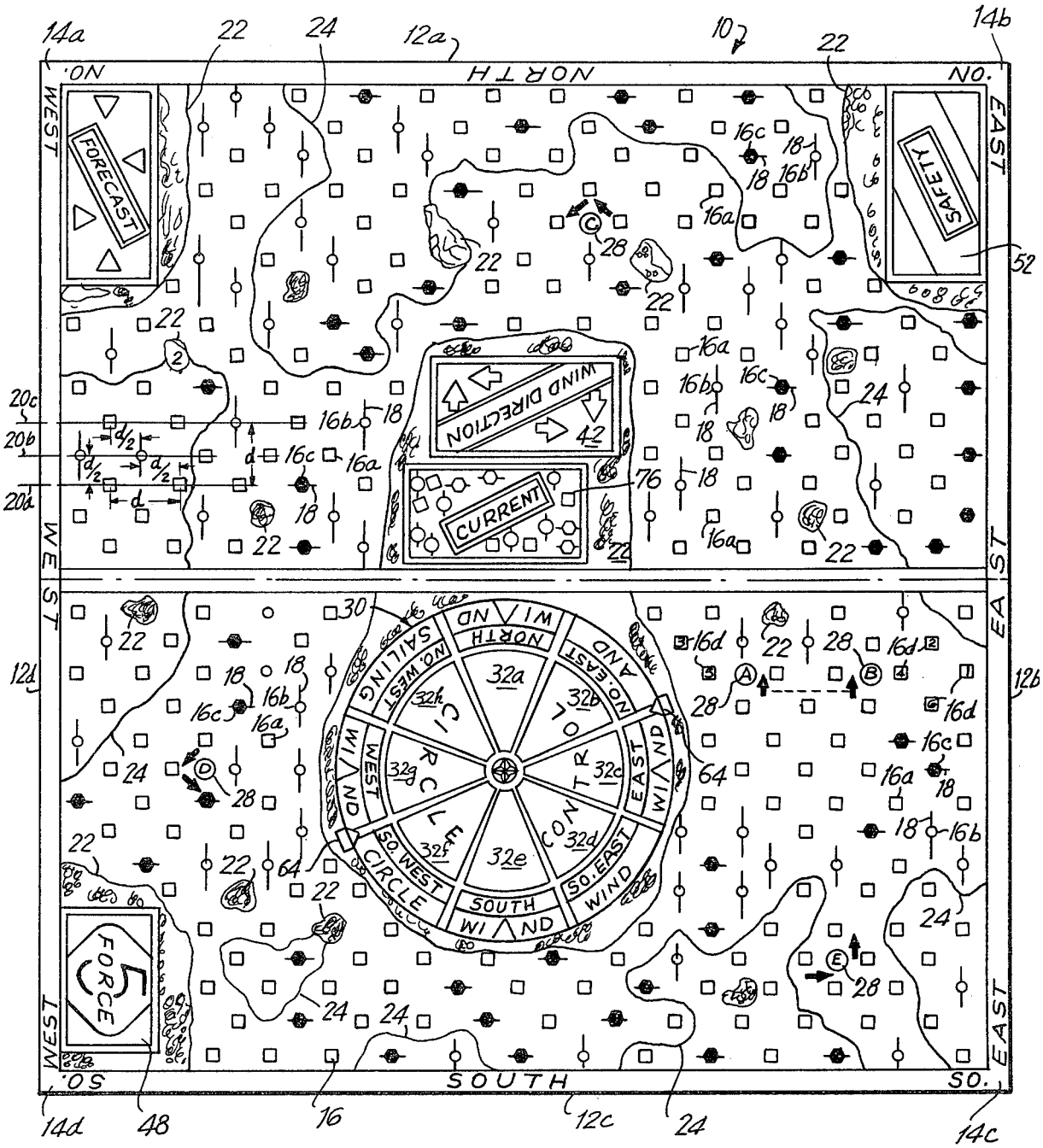
FIG. 1 is a plan view of a game board comprising a component of the apparatus of the present invention.

Referring now to the drawings wherein like reference characters designate identical or corresponding parts throughout the several views, and more particularly to FIG. 1, the game board, generally designated 10, is of flat rectangular form and has at each of its sides and corners indicia designating a respective compass direction. Thus, on sides **12*a*, 12*b*, 12*c* and 12*d*, indicia designating "north", "east", "south", and "west" are provided. Similarly, at game board corners 14***a*, 14*b*, 14*c* and 14*d*, indicia designating "northwest", "northeast", "southeast", and "southwest" are designated.

A plurality of movement spaces 16 are provided on the major area of game board 10, which major area constitutes a so-called water area. In the illustrated embodiment, there are three types of movement spaces, namely square movement spaces 16*a*, round movement spaces 16*b*, and hexagonal movement spaces 16*c*. Moreover, the round and hexagonal movement spaces 16*b* and 16*c* have directional indicia 18 associated therewith. A more detailed description of the significance of the three types of movement spaces as well as the directional indicia is set forth hereinbelow.

The movement spaces 16 are arranged in a plurality of rows which extend across the board in an east-west direction or horizontally as seen in FIG. 1. For purposes of description, three rows of movement spaces are designated by dashed lines 20*a*, 20*b*, and 20*c*.

The movement spaces in each row are equally spaced from one another by a distance d as seen in row 20*a*. Adjacent rows are spaced from each other by a distance which is equal to one half of the distance by which the movement spaces in each row are separated from one another. For example, rows 20*a* and 20*b* are separated from each other by a distance of d/2. Moreover, movement spaces 16 of one row are displaced with respect to the movement spaces of an adjacent row by one-half the distance d so that rows 20*a* and 20*b* are separated by a distance d/2. In this manner the movement spaces 16 in alternate rows, e.g., rows 20*a* and 20*c*, are aligned with each other to form a plurality of columns of movement spaces, the columns extending in the north-south direction and the movement spaces 16 in each column are equally spaced from one another by the distance d.

From the foregoing, it is seen that each row of movement spaces 16 defines an east-west movement direction while each column of movement spaces 16 defines a north-south movement direction. Moreover, the rows and columns of movement spaces together define a plurality of diagonal movement directions, i.e., a plurality of northwest-southeast movement directions and a plurality of northeast-southwest movement directions.

A plurality of areas 22 are provided on game board 10 which constitute land areas. Some of the land areas are sufficiently small so as to be situated in the space defined between adjacent movement spaces while other land areas are larger and interrupt the rows of movement spaces 16. In all cases, the land areas 22 are devoid of any movement spaces 16.

The major area of the game board 10 constituting the water area on which the movement spaces 16 are provided is itself provided with indicia which divides the water area into areas of varying wind strengths. For example, boundary lines 24 are designated on the playing area which encompass or border areas within them which constitute "weak wind" areas and which may be distinguished from "strong wind" areas by color indicia. For example, the weak wind areas may be designated by a light blue color while the strong wind areas may be designated by a dark blue or green color. The movement of the movement pieces of the game apparatus can be governed by the "wind" of the area on which the movement piece is located according to the rules of the game described below.

A plurality of movement pieces 26, one of which is illustrated in FIG. 8, are provided, each movement piece 26 representing a sailboat, the pieces being adapted to be moved over the game board playing area on the movement spaces 16 in certain movement directions. Each movement piece 26 is provided with indicia, such as a certain color, to distinguish it from the other movement pieces.

A plurality of course marking indicators 28 are provided on the game board playing area to define a path for the movement pieces 26. In the illustrated embodiment, the course marking indicators 28 comprise five circles, each having a respective notation A, B, C, D and E. Moreover, certain ones of the movement spaces constitute "starting points" for the movement pieces 26. In the illustrated embodiment, there are six of such starting point movement spaces, designated 16*d*, each such movement space 16*d* being designated by a number 1, 2, 3, 4, 5 and 6.

According to the invention, the playing area of game board 10 has a movement direction indicator, designated 30, provided thereon. In the illustrated embodiment, the movement direction indicator 30 defines eight areas 32*a*–32*h*, each of which extends radially from a common origin in a respective one of the movement directions. Thus, movement direction area 32*a* extends in a northerly direction, area 32*b* extends in a northeasterly direction, area 32*c* extend in an easterly direction, etc. Each of the areas 32 may be provided with indicia indicating the particular movement direction which it designates. As discussed below in connection with the operation of the game apparatus of the present invention, a movement direction indicator of the type described above is especially useful in connection with a sailboat race simulating game in that it is possible to ascertain the direction in which a movement piece has been moving even when the movement piece is stationary on the game board.

A set of control markers 34 are also provided, one of which is illustrated in FIG. 8. Each control marker 34 has indicia which corresponds to the distinguishing indicia provided on the movement pieces 26. For example, each control marker 34 may have a color which is the same as the color of a corresponding one of the movement pieces 26. The control markers 34 are adapted to be placed in one of the areas 32 of the movement direction indicator 30 to indicate the particular direction in which the movement piece 26 to which it corresponds is moving as described below.

Figure 3B:
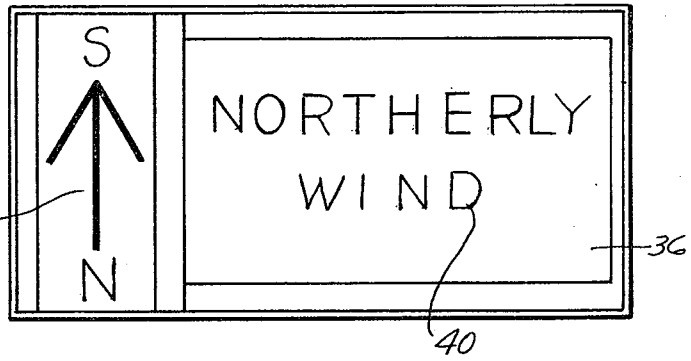
FIGS. 3A and 3B are top and bottom views of a typical one of a set of wind direction cards.
Figure 3A:
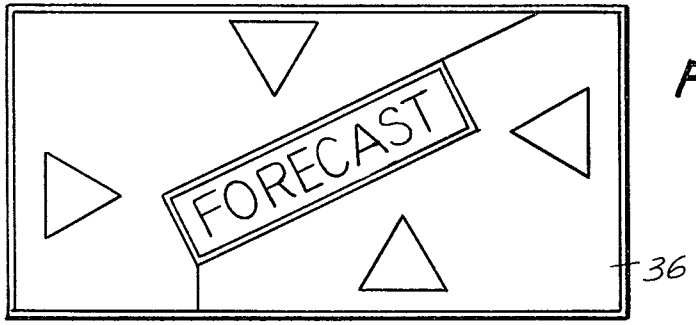

A group of wind direction cards 36 (FIG. 3) are provided, each of the wind direction cards 36 having indicia provided thereon designating a particular one of the movement directions on the game board playing area. In a preferred embodiment, four such cards are provided, each card 36 having an arrow 38 which points in one of the northerly, easterly, southerly or westerly directions and also including a written notation 40 designating the direction of the wind. Furthermore, a card positioning area 42 is provided on the game board 10 on which one of the wind direction cards 36 is positionable in a manner such that the arrow 38 on that card will point in the particular direction designated by indicia 40. Thus, for example, if wind direction card 36 illustrated in FIG. 3 were correctly placed on the positioning area 42 on game board 10, the arrow 38 will point from the north to the south so as to designate a northerly wind. Similarly, a wind direction card designating an easterly wind will have an arrow which will point from the east to the west when that card is placed on the card positioning area 42 of the game board. In this manner, a game player may quickly and easily ascertain the direction in which the prevailing wind is blowing at any time during game play.

In the illustrated embodiment of the game apparatus of the present invention, three sets of play variation cards are also utilized. A first set of such play variation cards comprises so-called "Spinnaker" cards, a typical one of which is illustrated in FIG. 6. A sufficient number of such Spinnaker cards are provided so as to enable one of such cards to be provided to each of the players of the game. Indicia 44 is provided on the top of each Spinnaker card to designate the sequence of player turns while indicia 46 are provided on the bottom of each Spinnaker card which constitute instructions as to the extent of possible movement of a movement piece.

A second set of such play variation cards comprises so-called "Force Five" cards, a typical one of which is illustrated in FIG. 5. There may be twenty-four of such Force Five cards provided and this group of cards is situated on a card positioning area 48 on game board 10. Each Force Five card has indicia 50 which will determine the ability of a player to make extra moves, the loss of moves available to a player, a change in the wind direction, etc.

Figure 2B:
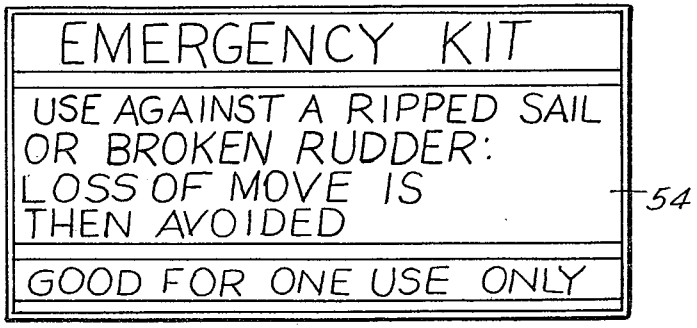
FIGS. 2A and 2B are top and bottom views, respectively, of a typical one of a set of play variation cards.
Figure 2A:
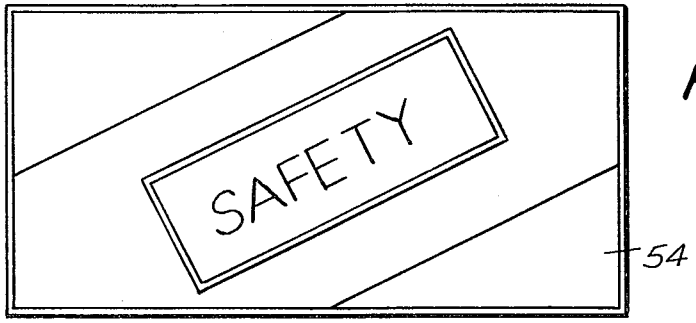

Finally, a third set of such play variation cards comprises so-called "Safety" cards, a typical one of which is illustrated in FIG. 2. There may be twenty-four of such Safety cards which are placed on a card locating area 52 on game board 10. The Safety cards include indicia 54 which may designate the avoidance of a loss of move, i.e., avoid the affect of a "Force Five" card, which may provide for extra moves for a player, which may be utilized to allow a player to block an opponent's movement to a space occupied by the movement piece of the player, etc.

The manner of play of the game apparatus described above will now be set forth.

The object of the game is to be the first player to move his movement piece around the racing course. Each player draws a "Spinnaker" card which indicates by indicia 44 the order of turns for the players. Each player places his movement piece on a starting point space **16*b* whose number corresponds to that players turn. The racing course is defined by the course marking indicators 28 and each player must move his movement piece around the "outside" of each respective course marking indicator 28** as indicated by the arrows associated therewith.

A wind direction card 36 is chosen and placed in the card positioning area 42 so that the arrow 38 is pointing in the direction towards which the wind is blowing.

Three "Safety" cards (FIG. 2) are given to each player and one "Spinnaker" card (FIG. 6) is also given to each player.

The player whose turn it is to move first as indicated by the indicia 44 on the "Spinnaker" card drawn by him will then place the control marker 34 which corresponds to his movement piece 26 in the area 32 of movement direction indicator 30 which designates the direction in which he tends to move his movement piece. Each movement piece must move in a straight line along the line of movement spaces 16 and stop on a movement space. The player can move his movement piece in a north-south direction, in a east-west direction, or diagonally, i.e., in a northwest-southeast or northeast-southwest, direction. Each player's move can extend up to eight movement spaces except that a movement piece cannot be moved across a land area 22 or across a course marking indicator 28. However, a player's control marker 34 must at all times indicate the direction of movement of that players movement piece.

When it is his turn at the beginning of a game, a player places his control marker 34 in the appropriate area 32 to show the direction of movement of his movement piece 26. The movement piece can then be moved up to eight movement spaces. A movement piece leaving the starting space **16*d* should be moved south of course marking indicators 28 designated A and B and then northwardly between indicators A and B up to indicator 28C. After passing indicator C, the movement piece moves on to indicators D and E. As noted above, the indicator 28** must be passed on the side indicated by the arrows. Once a movement piece has passed indicator E, it is then moved back to indicators A and B passing again between these indicators to end the game.

As noted above, it is necessary for a player to place his control marker 34 in one of the areas 32 of the movement direction indicator 30 to indicate to the other players in which movement direction his movement piece will move. For example, prior to a player moving his movement piece in a northerly direction, he must place his control marker in area **32*a* of movement direction indicator 30. Once a player has indicated that the movement direction of his movement piece is in a particular direction, the player need not move his control marker if his movement piece continues in the same direction. However, if the movement piece is to be moved in a subsequent move in a different direction, it can only be moved up to 3 spaces in its first move and the control marker must be moved to the appropriate area 32** to indicate the new direction of movement prior to that player moving his movement piece. If a player forgets to move his control marker to indicate a new direction of movement, an appropriate penalty is imposed. For example, if another player discovers the omission, all of the other players may be allowed to make extra moves when it is their turn to play.

As noted above, a wind direction card 36 has been positioned in area 42 such that the arrow 38 is pointing in the direction in which the wind is set to be blowing. No player is permitted to move his movement piece in a direction directly into the wind. If a player does so, an appropriate penalty may be imposed such, for example, as that player losing his move. However, players may move their movement pieces diagonally toward the wind direction.

The various play variation cards illustrated in FIGS. 2, 5 and 6 may be utilized according to any desired rules. For example, a Spinnaker card (FIG. 2) may allow a player to make five separate moves on one turn. All five moves must be within the weak wind water areas and cannot cross over a strong wind area. Such card can be used only one time during the play of the game by each player. A player starting his move from a strong wind area may draw a Force Five card (FIG. 5) and follow whatever directions are set forth by indicia 50 provided thereon. Such directions may include wind changes which require another wind direction card 36 to be placed in area 42 on game board 10. The Force Five cards may also provide that the player get extra moves or may lose moves. Referring to the "Safety" cards (FIG. 2), a player may begin the game with three of such cards, each of which may be used only once. The player uses such cards by following the direction set forth by indicia 54 provided thereon which may, for example, may indicate the avoidance of the loss of move or the obtaining of extra moves or the ability to block and stop an opponent moving through a space occupied by that players movement piece.

The winner of the game is the first player to move his movement piece around the racing course and return to the starting point.

The game apparatus of the present invention includes apparatus enabling the play of the game on a more advanced level. In this advanced level of play, provisions are made for simulating the affect of current flow on the movement of the movement pieces.

The round and hexagonal movement spaces 16*b* and 16*c* are designated "strong current spaces" and the directional indicia 18 associated with the spaces designate the direction in which the current is moving under circumstances described below.

A sailing method indicator member 56 (FIGS. 7 and 8) is provided for use in the advanced level of play. The sailing method indicator member 56 functions to classify the particular direction of movement of a movement piece 26 according to its relationship to the selected wind direction. In the illustrated embodiment, the sailing method indicator member is constituted by a ring-shaped annular member 58 which is adapted to be removably fixed to the game board in any one of a number of orientations according to the selected wind direction. Referring to FIG. 7, the annular member 58 is divided into eight segments 60*a*–60*h* in which certain indicia are provided as discussed below. Four notches 62 are formed on the outer edge of annular member 58 equally spaced from one another at 90° intervals. A pair of stop members 64 (FIGS. 1, 7 and 8) are fixed to the game board 10 at diametrically opposed sides of the movement direction indicator 30, the stop member 64 being formed so as be receivable within opposed pairs of notches 62. In this manner, the annular member 58 comprising the sailing method indicator member 56 can be selectively positioned in any one of four positions having a common center, namely the center of the movement direction indicator 30.

Referring again to FIG. 7, an arrow 66 is designated in segment 60*a* of annular member 58 and this arrow will designate the wind direction which is prevailing at any time during the play of the game. Radially outwardly directed arrows 68 are provided in each of the remaining seven segments 60*b*–60*h* and designate movement directions of movement pieces 26. In the two segments adjacent to segment 60*a*, namely segments 60*b* and 60*h*, the designation "beating" is provided. In the four segments 60*c*, 60*d*, 60*f* and 60*g*, the designation "reaching" is provided. Finally, in the remaining segment 60*e*, the designation "running" is provided.

The play of the advanced level of the game apparatus of the present invention will now be described.

Generally, the same rules as described above in connection with the basic level of play apply. However, the sailing method indicator member 56 is selectively affixed to game board 10 in a manner such that the wind direction arrow 66 points in the direction of the prevailing wind, determined by the particular wind direction card 36 located in the card positioning area 42. For example, in the illustration of FIG. 7, a northerly wind is prevailing, i.e., the wind is moving from the north towards the south so that the ring-shaped annular member 58 is affixed to the game board 10 with arrow 66 pointing towards the south. The stop members 64 are received in appropriate notches 62 to removably hold the sailing method indicator member 56 in its proper position.

During play, any movement piece 26 moving in the direction of arrows 68 provided in the "beating" segments 60*b* and 60*h* are said to be beating. Similarly, if a movement piece is moving in the direction of arrows 68 found in segments 60*c*, 60*d*, 60*f* or 60*g*, that movement piece is said to be "reaching". Finally, if a movement piece is moving in the direction of the arrow 68 of segment 60*e*, that movement piece is said to be "running".

Thus, with a prevailing northerly wind as shown, if the movement piece is moving in either a northwest or a northeast direction, it is said to be beating. If the movement piece is moving in an easterly, westerly, southwesterly, or southeasterly direction, it is said to be reaching. Finally, if the movement piece is moving in a southerly direction, i.e., with the wind, it is said to be running.

Figure 4B:
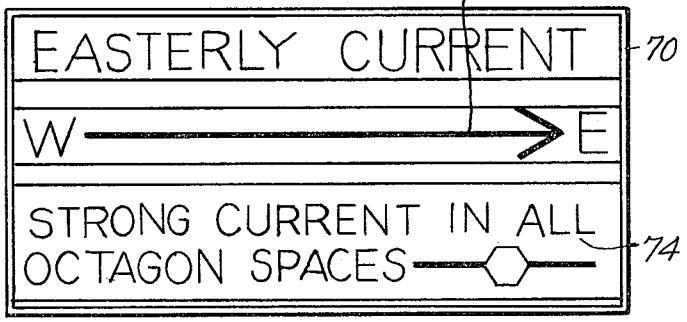
FIGS. 4A and 4B are top and bottom views of a typical one of a set of current direction cards.
Figure 4A:
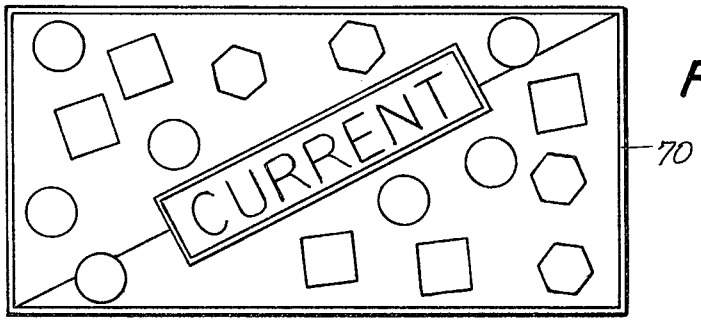

A set of "current direction" cards is provided, a typical one of which is illustrated in FIG. 4 and designated 70. Each current direction card has an arrow 72 indicating the current direction and, additionally, is provided with indicia 74 indicating which movement spaces, i.e., which of the movement spaces 16*b* or 16*c*, are affected by a strong current. Prior to game play, one of the current direction cards is placed in the card locating area 76 on game board 10.

As noted above, the same rules apply in the play of the advanced level of the game apparatus as described above in connection with the basic game play. However, when a player is using a "reaching" sailing method, he is permitted to move up to eight spaces and then make a change in his movement direction of up to three spaces within the same move or turn. However, players who are using a "beating" or "running" sailing method are not permitted to make an extra course change move. When a player begins a move from a strong current space as indicated by the current direction card 70, he may make two moves during his turn if moving directly or diagonally with the current. The extra move within the same move when using a "reaching" sailing method is not allowed when moving against the current.

Moreover, according to the disclosed preferred set of rules, players using a "beating" sailing method may not use the Spinnaker card in order to gain five separate moves on one turn.

Thus, it is seen that the sailing method indicator member 56 and current direction cards 70, together with the particular configurations of the movement spaces 16*b* and 16*c*, combine to simulate both the wind direction and current direction factors which are normally found in actual sailing activities. The sailing method indicator member 56 classifies the particular direction in which the movement piece is moving with respect to the direction of wind and such movement classification directly affects the extent of movement of a movement piece relative to the direction of the current which is prevailing.

Clearly, the game apparatus of the present invention can be played in accordance with rules which vary from those described above. Thus, the rules of play described above have been set forth merely for illustrative purposes to exemplify the use of the game apparatus of the invention.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Sailboat race board game apparatus comprising:

a game board having a playing area on a major area of which a plurality of movement spaces are designated, said major area constituting a water area, said movement spaces being arranged in a plurality of rows, the movement spaces in each row being equally spaced from one another by a certain distance, and wheren adjacent rows are spaced from each other by one-half of said certain distance, and wherein the movement spaces of one row are displaced with respect to the movement spaces of an adjacent row by one-half of said certain distance, so that the movement spaces in alternate rows are aligned with each other to form a plurality of columns of said movement spaces, the movement spaces in each column being equally spaced from one another by said certain distance, whereby each row of movement spaces defines an east-west movement direction, each column of movement spaces defines a north-south movemet direction, and said rows and columns of movement spaces together define a plurality of northwest-southeast movement directions and a plurality of northeast-southwest movement directions, said game board having a movement direction indicator provided thereon, said movement direction indicator defining eight areas for designatng, respectivly, northerly, southerly, easterly, westerly, northwesterly, northeasterly, southwesterly and southeasterly movement directions of a movement piece;

a plurality of movement pieces adapted to be moved over said game board playing area on said movement spaces in said movement directions, each of said movement pieces being provided with distinguishing indicia;

means adapted to cooperate with said movement direction indicator provided on said game board for indicating the direction of movement of each of said plurality of movement pieces; and wherein said means for indicating the direction of movement of each of said movement pieces are constituted by a plurality of control markers, each of said control markers being provided with indicia corresonding to said indicia provided on a respective movement piece, said control markers being selectively situatable on any one of said movement direction indicator areas to designate the direction of movement of said corresponding movement pieces on said gameboard playing area.

2. The combination of claim 1 wherein each of said eight areas of said movement direction indicator extends radially from a common origin in a respective one of said movement directions.

3. The combination of claim 2 wherein each of said eight areas has indicia associated therewith indicating a respective movement direction.

4. The combination of claim 1 wherein said playing area of said game board has areas formed thereon designating land areas, said land areas interrupting said rows of movement spaces and being devoid of said movement spaces.

5. The combination of claim 4 wherein a plurality of course marking indicators are provided on said game board play area between said movement spaces to define a path for said movement pieces.

6. The combination of claim 1 further including a group of wind direction cards, each of said cards having indicia provided thereon designating a particular one of said movement directions on said gameboard playing area.

7. The combination of claim 6 wherein said gameboard has a card positioning area provided thereon on which one of said wind direction cards is positionable and wherein said indicia provided on said wind direction cards includes arrows pointing in respective directions, and wherein said card positioning area is designated such that when a respective card is positioned on said area the arrow provided on said card points in a respective movement direction.

8. The combination of claim 6 further including at least one additional group of play variation cards for determining the manner of play of said game.

9. The combination of claim 1 wherein said major area of said gameboard constituting said water area is provided with wind stength designating indicia dividing the water area into areas of various depths, whereby the movement of said movement pieces is governed by the wind strength in the area on which said movement piece is located.

10. The combination of claim 1 wherein at least a portion of said plurality of movement spaces include current indicia provided thereon designating a particular one of said movement directions on said gameboard playing area.

11. The combination of claim 10 further including a group of current direction cards, each of said cards having indicia provided thereon corresponding to said current indicia provided on said movement spaces.

12. Sailboat race board game apparatus comprising:

a game board having a playing area on a major area of which a plurality of movement spaces are designated, said major area constituting a water area, said movement spaces being arranged in a plurality of rows, the movement spaces in each row being equally spaced from one another by a certain distance, and wherein adjacent rows are spaced from each other by one-half of said certain distance, and wherein the movement spaces of one row are displaced with respect to the movement spaces of an adjacent row by one-half of said certain distance, so that the movement spaces in alternate rows are aligned with each other to form a plurality of columns of said movement spaces, the movement spaces in each column being equally spaced from one another by said certain distance, whereby each row of movement spaces defines an east-west movement direction, each column of movement spaces defines a north-south movement direction, and said rows and columns of movement spaces together define a plurality of northwest-southeast movement directions and a plurality of northeast-southwest movement directions, said game board having a movement direction indicator provided thereon, said movement direction indicator defining eight areas for designating, respectively, northerly, southerly, easterly, westerly, northwesterly, northeasterly, southwesterly and southeasterly movement directions of a movement piece;

a plurality of movement pieces adapted to be moved over said game board playing area on said movement spaces in said movement directions;

means adapted to cooperate with said movement direction indicator provided on said game board for indicating the direction of movement of each of said plurality of movement pieces;

means for selectively designating one of said movement directions as the wind direction;

sailing method indicator means adapted to be removably affixed to said gameboard for classifying the particular direction of movement of a movement piece according to its relationship to the selected wind direction; and means for removably affixing said sailing method indicator means to said gameboard in any one of a number of orientations according to the selected wind direction.

13. The combination of claim 12 wherein said sailing method indicator means include indicia provided thereon for designating the selected wind direction when said sailing method indicator means is removably affixed to said gameboard.

14. The combination of claim 13 wherein said sailing method indicator means is constituted by a ring-shaped annular member and wherein said annular member has a first set of indicia provided along its circumference designating various classifications of the particular movement direction of a game piece with respect to the wind direction and said indicia for designating the selected wind direction.

15. The combination of claim 14 wherein said one surface of said annular member is divided into eight equal segments, said indicia for designating the selected wind direction being situated in one of said segments and said movement direction classifying indicia being situated in the remaining seven of said segments.

16. The combination of claim 15 wherein said means for removably affixing said sailing method indicator means constituted by said annular ring to said gameboard include means for removably affixing said ring to said gameboard in any one of four positions having a common center, each position of affixation of said ring being rotated relative to another such position by an angle having a factor of 90°.

* * * * *